United States Patent [19]

Combette et al.

[11] 4,189,081

[45] Feb. 19, 1980

[54] RETURN PAWL FOR POWDER-ACTUATED TOOL

[75] Inventors: Marc Combette, Valence; François Noiray, Bourg-les-Valence, both of France

[73] Assignee: Societe de Prospection et d'Inventions Techniques SPIT, Bourg-les-Valence, France

[21] Appl. No.: 943,584

[22] Filed: Sep. 18, 1978

[51] Int. Cl.[2] ..... B25C 1/14

[52] U.S. Cl. ..... 227/10; 60/635; 60/636

[58] Field of Search ..... 60/635, 636; 227/10

[56] References Cited

U.S. PATENT DOCUMENTS

| | | | |
|---|---|---|---|
| 3,497,125 | 2/1970 | O'Brien | 227/10 |
| 3,548,590 | 12/1970 | Mulno | 60/636 |
| 3,549,074 | 12/1970 | Brunelle | 227/10 |
| 3,820,266 | 6/1974 | Larsson | 227/10 |
| 3,915,242 | 10/1975 | Bell | 227/10 |

FOREIGN PATENT DOCUMENTS

| | | | |
|---|---|---|---|
| 2263764 | 7/1974 | Fed. Rep. of Germany | 227/10 |
| 1570887 | 6/1969 | France | 227/10 |

*Primary Examiner*—John McQuade

*Attorney, Agent, or Firm*—William W. Jones; Paul J. Lerner

[57] ABSTRACT

A powder-actuated fastening tool is provided with a return pawl slideable within a pawl-holder fixed to the barrel-holder, between a piston engaging position, wherein the pawl, protruding through a longitudinal slot in the barrel engages the piston during the opening of the tool, while at least one boss, formed on the pawl, engages a first plane milled surface of the barrel, and a cocked position, where a second plane milled surface of the barrel, more remote from the barrel axis than the first surface, engages the boss to retract the pawl, the two milled surfaces being connected by a transverse groove which the boss can engage to maintain the barrel in its locked and non-cocked position.

7 Claims, 12 Drawing Figures

RETURN PAWL FOR POWDER-ACTUATED TOOL

BACKGROUND

The present invention relates to a powder-actuated fastening tool with a hammer piston and, more particularly, to a pawl for returning the hammer piston in its firing position.

Powder-actuated fastening tools are known in the art wherein cocking is achieved by pressing the tool muzzle against the surface of the material intended for receiving the anchoring member, causing retraction of the pawl, the pawl resuming its idle position during the opening of the apparatus, in order to return the piston to its firing position.

The barrel of such an apparatus is formed with a longitudinal slot and two plane milled surfaces parallel to the barrel axis and connected through a ramp. The pawl of such an apparatus is slidably mounted within a pawl holder fixed to the casing. The pawl is biased to its idle position by resilient means, and comprises bosses shaped for engaging the barrel milled surfaces. The operative end of the pawl projects into the slot and is shaped so as to engage, in its idle position, the piston.

The pawl being in its idle position, that is in the position where the piston is in an upward position, its bosses engage the first milled surface closest to the barrel axis. When the apparatus is pressed against the material, the bosses slide, against the action of the resilient means, from the first milled surface to the second milled surface, which is more remote from the barrel axis than the first, causing the operative end of the pawl to retract so as not to project into the barrel.

For safety reasons, the cocking of such an apparatus is achieved by pressing it against the material intended for receiving the anchoring member. In order to facilitate the handling of the apparatus once a cartridge has been loaded, means may be provided which are arranged in such manner as to maintain the barrel in its closed but non-cocked position. Generally, the closing is resilient, but it requires an extra part such as a clip.

SUMMARY OF THE INVENTION

The primary object of the present invention is, therefore, to eliminate this extra part. To this end, the invention relates to a fastening tool having a hammer piston and a hammer piston return pawl slidably mounted in a pawl-holder fixed to the barrel-holder of the apparatus and movable between a piston engaging position, to which the pawl is returned by resilient means, wherein it projects through a longitudinal slot of the barrel into the bore of said barrel, and engages the piston during the opening of the apparatus, at least one boss formed on the pawl engaging a first plane milled surface provided on the barrel, and an apparatus cocking position, in which a second plane milled surface, provided on the barrel and more remote from the barrel axis than the first surface, engages the boss for retracting the pawl, the two milled surfaces being connected by means of a transverse groove which the boss is intended to engage for maintaining the barrel in its closed but non-cocked position.

By means of this invention, the return of the hammer piston during the opening of the fastener tool arranged and constructed according to the invention, and the maintaining of the barrel in its closed position before cocking the apparatus, are achieved without the help of an extra part. When the apparatus is pressed against the material intended for receiving the anchoring member, the barrel-holder, and the pawl are brought forward, in relation to the barrel, against the action of its biasing means; the pawl is then urged outside the barrel bore for engaging the second milled surface. After firing, when the apparatus is no longer pressed against the material, the barrel-holder slides rearwardly in relation to the barrel, and the pawl is disengaged from the second milled surface and returns to seat within the transverse groove of the barrel which is thus resiliently re-locked, a voluntary opening of the apparatus being nonetheless possible.

In a preferred embodiment of the apparatus according to the invention, the transverse groove is formed with a plane bottom connected to said milled surfaces through ramps inclined in reverse directions.

Conventional fastening tools suffer from the possibility of an eventual fault in the installation of the pawl in its pawl-holder, whereby the barrel may be blocked in its cocked position, thus overriding the safety device which prevents discharge of the tool unless the muzzle is pressed against the workpiece.

A further object of the present invention is to eliminate such a disadvantage. To this end, the pawl and the pawl-holder are arranged so as to form at least one recess, orientation means, comprising at least one pin, being provided for cooperating with the recess and guiding the pawl in the pawl-holder.

If the pawl is incorrectly inserted into the pawl-holder, the pin cannot cooperate with the recess and the pawl is prevented from being introduced further into the pawl-holder in such manner that no action applied on the pawl may bring it into cooperation with the tool barrel.

To further ensure that the pawl is not installed backwards, it is formed of a length such that the closure cap of the pawl-holder cannot be secured to the latter if the pawl is not completely and therefore correctly put in position in the pawl-holder.

A further object of the present invention is to provide a pawl with a third function in relation with the evacuation of the combustion gases. In some conventional powder-actuated fastening tools, no particular means are provided for allowing such an evacuation, only a minute portion escaping through the barrel-holder, so that the combustion wastes accumulate in the forward portion of the barrel which very quickly becomes fouled.

In the case where the hereabove mentioned recess is formed in the fastening tool of the invention, said recess may extend in such manner as to from a passageway for the gases and combustion wastes. Such a passageway offers the advantage of allowing wastes which would otherwise accumulate on the pawl to be evacuated outside.

Finally, a last object of the invention relates to over-power firing. After such an over-power firing, the piston shank protrudes from the tool muzzle while the piston head may have passed down the barrel beyond the pawl. With conventional fastening tools, it is in such a case, necessary to dismantle the tool in order to "re-cock" the pawl, that is to position again the rearward end of the piston behind the pawl. An object of the invention is, therefore, to remedy such a disadvantage. To this end, a fastening tool is provided in which the rearward end of the piston head is formed with a bevelled edge in such manner that when the piston is urged back by pressing against its forward end, which protrudes outside of the apparatus, the piston may retract the pawl against the action of its biasing means until it resumes a position ahead of the operative part of the piston; this being accomplished without having to dismantle the tool.

DESCRIPTION OF THE DRAWINGS

The invention will become more apparent from the following description of a preferred embodiment of the apparatus of the invention, with reference to the accompanying drawings wherein:

FIGS. 2 are enlarged fragmentary, cross-sectional views, showing the pawl of FIG. 1 in its three barrel engaging positions;

FIGS. 7 show a series of axial cross-sectional views of the pawl in various orientations in the pawl-holder;

DESCRIPTION OF THE PREFERRED EMBODIMENT

Figure 1:
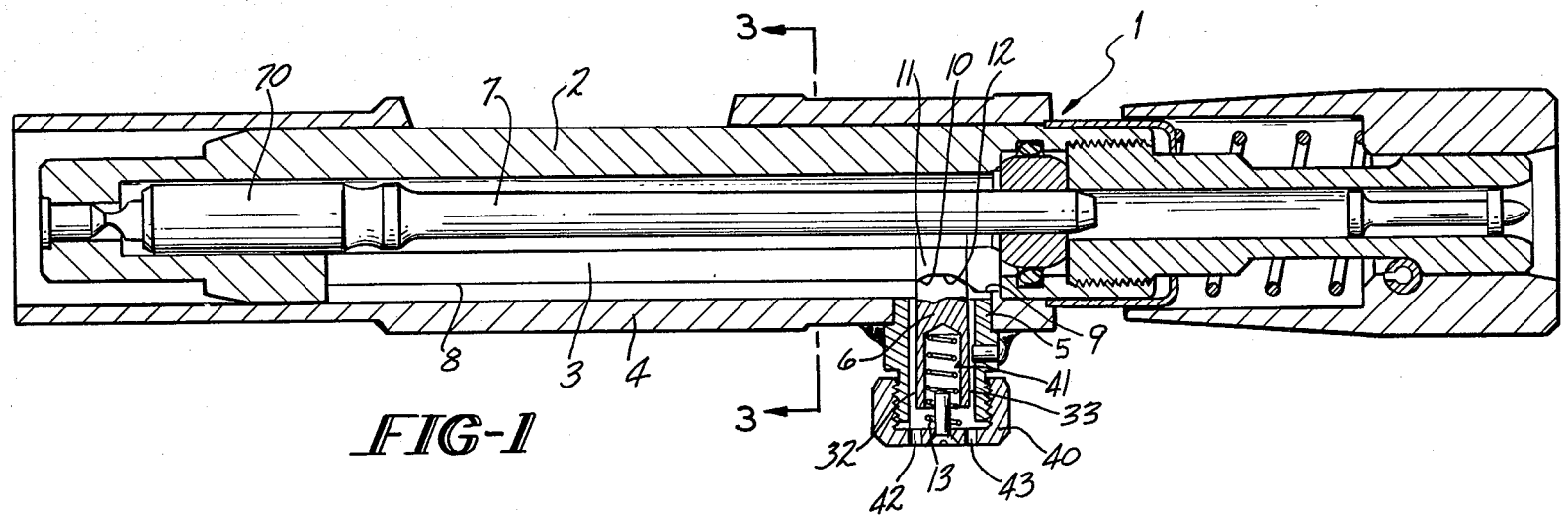
FIG. 1 is a fragmentary axial cross-sectional view of a tool arranged in accord with the invention, in closed position, after loading.

FIG. 1 shows tool 1 according to the invention having its barrel 2 formed with a longitudinal slot 3 parallel to its axis. The barrel-holder 4 of apparatus 1 has fixed thereto a pawl-holder 5 within which is slidably mounted a pawl 6, and which is closed by a cap 40. Two plane milled surfaces 8 and 9 are provided on barrel 2, connected by a transverse groove 10. Pawl 6, whose operative end 11 is adapted for engaging head 70 of hammer piston 7 comprises two bosses 12, symmetrical in relation to the pawl axis, which are intended for engaging the milled surfaces 8, 9 and the transverse groove 10 of barrel 2 of tool 1. Pawl 6 is returned to the piston engaging position by a spring 13 bearing against cap 40 and the bottom of a blind bore 41 formed inside pawl 6.

Figure 2C:
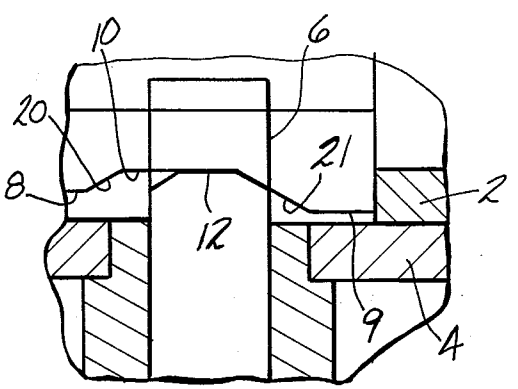
FIG. 2C showing the pawl locking the barrel.
Figure 2B:
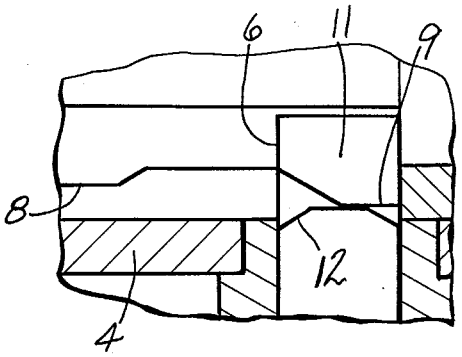
FIG. 2B showing the position of the pawl with the tool in the cocked condition.
Figure 2A:
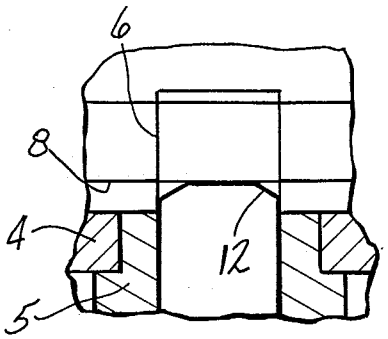
FIG. 2A showing the pawl in the upward, piston-engaging position.

The operation of tool 1 is illustrated in FIGS. 2. FIG. 2A shows pawl 6 in pawl-holder 5 in its upward position, wherein the piston 7 (not shown) is retained in its initial position, bosses 12 bearing on the milled surface 8 of barrel 2. This respective position of pawl 6 and piston 7 is achieved during the opening of tool 1 when the barrel 2 moves forward in relation to the barrel-holder 4. FIG. 2B shows the position of the pawl when the tool is in its cocked position bearing on the material intended for receiving an anchoring member. While the tool muzzle is pressed against the material, which action brings forward the barrel-holder 4 in relation to barrel 2, bosses 12 are disengaged from the milled surface 8 and are urged to engage the milled surface 9 more remote from the barrel axis 2 than the milled surface 8, the cooperation of the milled surface 9 and the bosses 12 causing the retraction of the operative end 11 of pawl 6 so as not to protrude into the barrel bore.

FIG. 2C shows the pawl, the tool being closed, bosses 12 of pawl 6 engaging the plane bottom of groove 10 which connects the two plane milled surfaces 8 and 9 through the inclined ramps 20 and 21. In this position of pawl 6, barrel 2 of tool 1 is resiliently locked. In order to now cock tool 1 by pressing it against the material intended for receiving the anchoring member, the force of the biasing spring 13 of pawl 6 must be counteracted in order to slide bosses 12 first along ramp 21, then outside groove 10, before bosses 12 engage, in the cocked position of tool 1, the milled surface 9, in which position pawl 6 is retracted. It is also necessary to counteract the force of the same biasing spring 13 in order to slide bosses 12 of pawl 6 in reverse direction along ramp 20, then outside of groove 10 before the bosses cooperate, in the open position of tool 1, with the milled surface 8 in the position shown in FIG. 2A in which the pawl can cooperate with piston 7. When, after firing, the tool is no longer pressed against the workpiece, the barrel-holder 4 slides rearwardly in relation to barrel 2, bosses of pawl 6 again protruding inside the transverse slot of barrel 2 which is therefore automatically relocked.

Pawl 6 is formed with two flat parts 30 and 31, symmetrical in relation to the pawl axis and orthogonal to bosses 12, which parts provide, between pawl 6 and the inner wall of pawl holder 5, both of which are cylindrical in the embodiment shown on the drawing, two ducts 32, 33 provided for orienting pawl 6 inside pawl-holder 5 and for evacuating the combustion wastes. Cap 40 is also formed with two passages 42, 43 corresponding to ducts 32, 33 through which the gases and combustion wastes may be evacuated.

The cylindrical general shape of pawl 6 and pawl-holder 5 shown in the drawing should not be considered as limitative for the invention. Other milled surfaces than flat parts, as for instance grooves or even bores, may also be considered for the evacuation of the gases through the pawl and pawl-holder, for instance parallelepipedal.

It is also within the spirit of the invention not to form the flat parts 30 and 31 along the whole length of pawl 6, and to provide only two blind recesses, provided only for orienting pawl 6 inside the pawl-holder 5 which is discussed herebelow, without therefore allowing the evacuation of the combustion wastes.

FIGS. 7 show the different orientations of pawl 6 in pawl-holder 5. In FIG. 7A, pawl 6 is in a correct position and a pin 50 protruding inside the pawl-holder 5 to which it is fixed, can engage the flat part 31 of pawl 6. Furthermore, the length of pawl 6 is such that cap 40 is completely screwed on the pawl-holder 5. Finally, a second pin 51 is seated in the blind core of pawl 6.

Figure 7A:
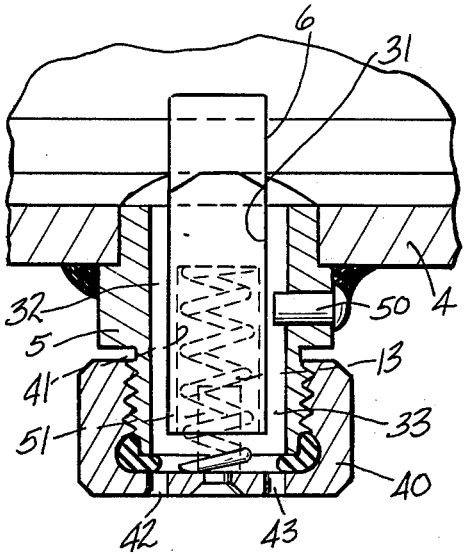
FIG. 7A showing the pawl in the correct orientation.
Figure 7B:
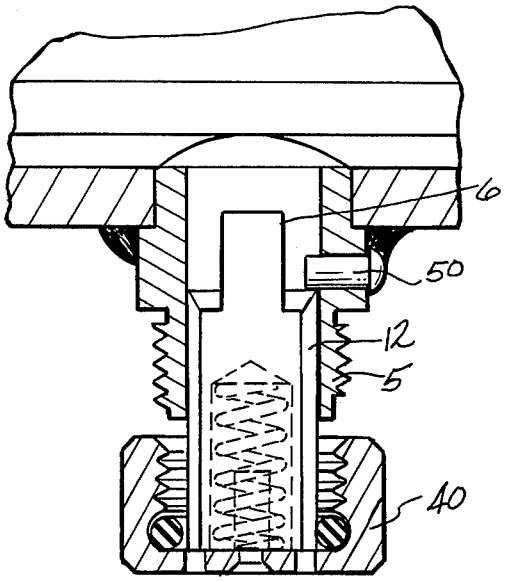
FIG. 7B showing the pawl rotated 90° from the proper orientation.
Figure 7C:
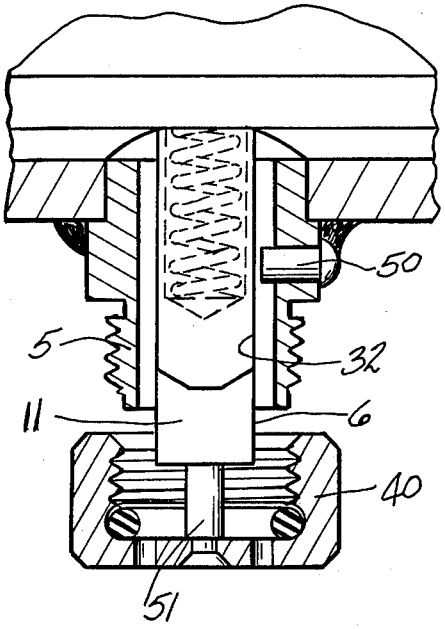
FIG. 7C showing the pawl inserted backwards.
Figure 7D:
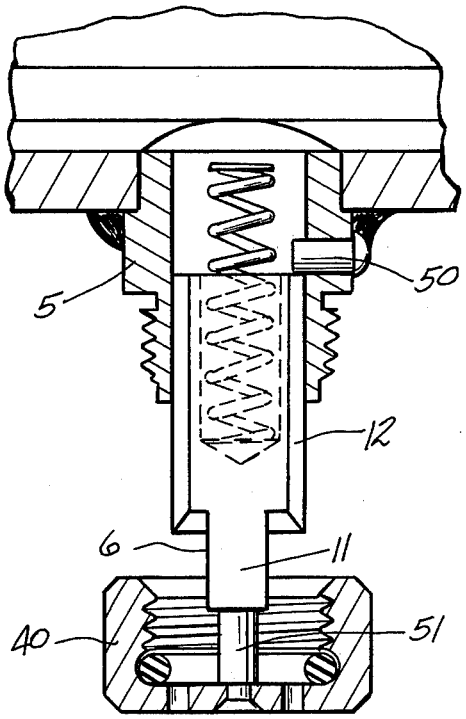
FIG. 7D showing the pawl inserted in the reverse direction to the pawl of FIG. 7B.

FIG. 7B shows an orientation in which pawl 6 is inserted in the pawl-holder after rotating 90 degrees in relation with its position as shown in FIG. 7A. In this orientation, the upper end of one of bosses 12 comes into abutment against pin 50 and, taking into account the length of the pawl, it is not possible to screw cap 40 onto pawl-holder 5. FIG. 7C shows an orientation in which pawl 6 is inserted backwards. In this event, pin 50 can still engage the flat part 32, but pin 51 comes into abutment against end 11 of pawl 6 which is not formed with a bore and it is still not possible, due to the pawl length, to screw cap 40 onto pawl-holder 5. FIG. 7D shows an orientation in which pawl 6 is inserted in reverse direction to that of FIG. 7B. Here, pin 50, against which one of bosses 12 comes in abutment, as well as the pin 51, which comes in abutment against end 11 of pawl 6, and the length of the latter, prevent cap 40 from being screwed onto pawl-holder 5. The securing of cap 40 onto pawl-holder 5 by screwing is of course non-limitative of the invention.

If, therefore, pawl 6 is incorrectly inserted into pawl-holder 5, it is impossible to install and maintain it in engagement with barrel 2 of tool 1, thus eliminating the possibility of blocking barrel 2 in its cocked position.

Figure 5:
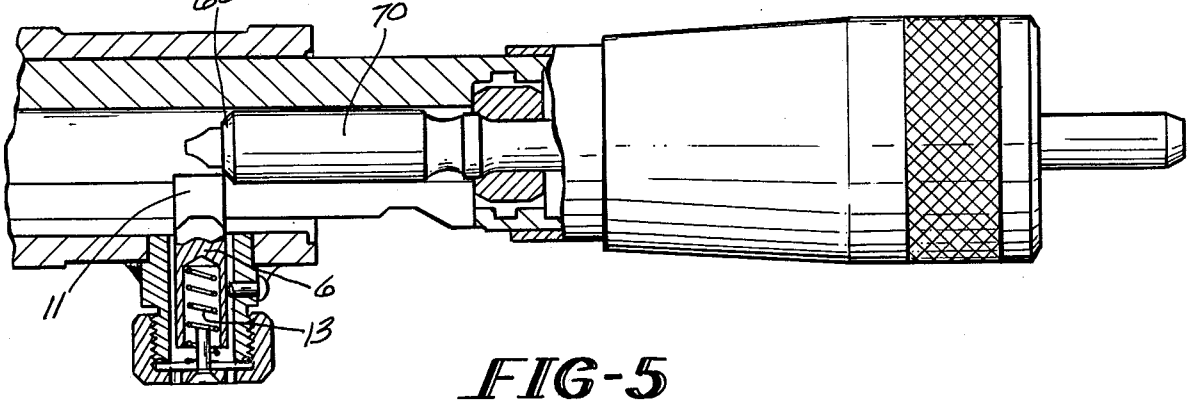
FIG. 5 is a fragmentary view, similar to that of FIG. 4, after an over-power firing, when the tool is open.
Figure 3:
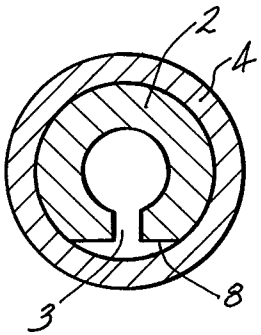
FIG. 3 is a transverse cross-sectional view of the tool of the invention, taken along line 3—3 of FIG. 1.
Figure 4:
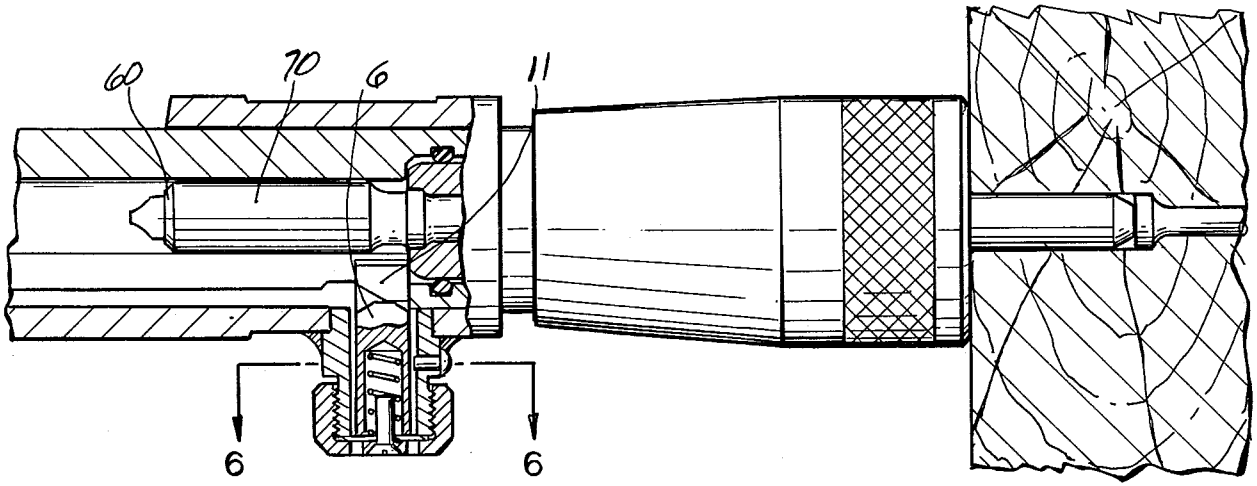
FIG. 4 is a fragmentary view, partly in axial cross-section of the tool of the invention, in cocked position after an over-power firing.
Figure 6:
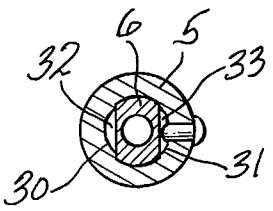
FIG. 6 is a transverse cross-sectional view of the pawl and the pawl-holder, along line 6—6 of FIG. 4.

Head 70 of piston 7 is formed, at its rearward end, with a bevelled edge 60. After an over-power firing, as shown in FIG. 4, head 70 has assumed a position preventing, when the tool is opened, the return of pawl 6 to its cooperation position with the forward part of head 70. This opening causes head 70 to pass ahead of pawl 6; pawl 6, under the action of spring 13, is then biased to its idle position in which the end 11 protrudes inside the barrel bore 2 as shown in FIG. 5. The forward end of piston 7 protruding outside of the apparatus, it is easy to push back the forward end of the piston. During the rearward movement of piston 7, and owing to bevelled edge 60, the rearward end of head 70 does not come into abutment against head 11 of pawl 6, but, on the contrary, causes retraction of pawl 6, against the action of spring 13, thereby allowing passage of head 70. The tool 1 of the invention is, therefore, arranged in order to be able, after an over-power firing, to recock pawl 6 without having to dismantle the tool. This arrangement also provides the possibility of assembling the tool without taking in account the relative position of the piston head and the pawl.

We claim:

1. A powder-actuated fastening tool of the type including a barrel holder, a barrel, having a longitudinal slot, movably carried within the barrel-holder for reciprocation, from an open position through a closed, but non-cocked, position to a cocked position and return, a hammer piston slidably disposed within said barrel, and a pistonbiasing pawl, slidably mounted within a pawl-holder fixed to said barrel-holder, movable between a piston-engaging position, wherein said pawl protrudes through said longitudinal slot and engages said piston during the opening of the tool while at least one boss, formed on said pawl, engages a first plane milled surface of said barrel, and a cocked position, wherein a second plane milled surface of said barrel, more remote from the barrel axis than said first surface engages said boss to retract said pawl, the improvement comprising: a transverse groove, formed in said barrel, connecting said first and second milled surfaces and adapted for engagement with said boss to retain said barrel in said closed, but non-cocked, position.

2. A fastening tool according to claim 1, wherein said transverse groove comprises a plane bottom and ramps connecting said bottom to said first and second milled surfaces, said ramps being inclined in reverse directions relative to each other.

3. A fastening tool according to claim 1, further comprising orienting means, said pawl and said pawl-holder defining at least one recess, and said orienting means cooperating with said recess to insure proper orientation of said pawl within said pawl-holder.

4. A fastening tool according to claim 3, wherein said pawl-holder is formed with at least one through bore, said bore and said recess together comprising a duct communicating between the interior of said barrel-holder and the atmosphere whereby combustion gases and wastes may be exhausted from the tool.

5. A fastening tool according to claim 3, wherein said recess is defined by a milled surface on said pawl and the interior surface of said pawl-holder.

6. A fastening tool according to claim 3, wherein said pawl-holder includes a removable end cap, said orienting means comprises a pin fixedly attached to said end cap; and said pawl includes an axially extending blind bore, said pin being insertable into said blind bore during assembly of said pawl and said pawl-holder, the lengths of said pawl, said pawl-holder and said pin and the depth of said blind bore being such as to prevent assembly of said parts if said pawl is inserted wrong-end first into said pawl-holder.

7. A fastening tool according to claim 1, wherein the rearward end of said piston is formed with a bevelled edge.

* * * * *